United States Patent [19]

Cleverley

[11] Patent Number: 4,797,217

[45] Date of Patent: Jan. 10, 1989

[54] OVERBASED ADDITIVES

[75] Inventor: John A. Cleverley, Didcot, United Kingdom

[73] Assignee: Exxon Chemical Patents Inc., Linden, N.J.

[21] Appl. No.: 895,839

[22] Filed: Aug. 12, 1986

[30] Foreign Application Priority Data

Aug. 13, 1985 [GB] United Kingdom ..... 8520254
Jan. 18, 1986 [GB] United Kingdom ..... 8601193

[51] Int. Cl.[4] ..... C10M 135/10

[52] U.S. Cl. ..... 252/42.7; 252/33; 252/41; 252/48.2

[58] Field of Search ..... 252/33, 41, 42.7

[56] References Cited

U.S. PATENT DOCUMENTS

| | | | |
|---|---|---|---|
| 2,356,661 | 8/1944 | Downing et al. | 252/37 |
| 2,920,105 | 1/1960 | Kluge et al. | 252/33 |
| 3,346,493 | 10/1967 | LeSuer | 252/32.5 |
| 3,428,561 | 2/1969 | LeSuer | 252/32.5 |
| 3,428,564 | 2/1969 | Bluestein et al. | 252/33 |
| 3,437,465 | 4/1969 | LeSuer | 44/51 |
| 3,471,403 | 10/1969 | LeSuer | 252/39 |
| 3,488,284 | 1/1970 | LeSuer | 252/33 |
| 3,489,682 | 1/1970 | LeSuer | 252/32.7 |
| 3,810,837 | 5/1974 | Chafetz et al. | 252/42.7 |
| 3,969,235 | 7/1976 | Sung et al. | 252/42.7 |
| 4,104,180 | 8/1978 | Burnop | 252/33 |
| 4,171,269 | 10/1979 | Sung et al. | 252/33 |
| 4,171,270 | 10/1979 | Sung et al. | 252/42.7 |
| 4,229,309 | 10/1980 | Cheng et al. | 252/33 |
| 4,320,016 | 3/1982 | Zoleski et al. | 252/42.7 |
| 4,326,972 | 4/1982 | Chamberlin, III | 252/33.3 |
| 4,514,313 | 4/1985 | Lecoent | 252/42.7 |

FOREIGN PATENT DOCUMENTS

| | | |
|---|---|---|
| 1388021 | 3/1975 | United Kingdom . |
| 1481553 | 8/1977 | United Kingdom . |
| 1551820 | 12/1979 | United Kingdom . |
| 2055885 | 6/1983 | United Kingdom . |
| 2055886 | 7/1983 | United Kingdom . |

*Primary Examiner*—William R. Dixon, Jr.
*Assistant Examiner*—Ellen McAvoy
*Attorney, Agent, or Firm*—J. B. Murray, Jr.

[57] ABSTRACT

A highly basic lithium sulphonate, having a TBN of at least 250 mgKOH/g is prepared by heating a mixture of lithium hydroxide monohydrate and a solvent to remove water as an azeotrope of water and said solvent prior to formation of the lithium salt of the sulphonic acid and subsequently overbasing with carbon dioxide.

9 Claims, No Drawings

OVERBASED ADDITIVES

This invention relates to overbased additives containing lithium sulphonate suitable for use in lubricants and fuels.

Lubricants often need the presence of detergents and there is an increasing need for detergent additives which have high basicity, especially in automobile lubricants where the high basicity neutralises acids formed during operation of the automobile engine. This invention relates to such high basicity or "overbased" additives which contain colloidally dispersed carbonate, and include lithium sulphonate.

Various patents disclose processes for making overbased additives containing alkali metals or alkaline earth metals and there are references to lithium sulphonates, but there is little if any teaching of how to make such additives from lithium hydroxide monohydrate, let alone the efficient process which we have devised. Examples of disclosures of preparations of overbased additives include GB Nos. 1388021, 1551820, 2055885, 2055886 and U.S. Pat. Nos. 3,346,493, 3,428,561, 3,437,465, 3,471,403, 3,488,284, 3,489,682 and 4,326,972.

In accordance with this invention, an oil solution of a highly basic lithium sulphonate is prepared by a process which comprises:

(i) heating lithium hydroxide monohydrate with a solvent to remove water as an azeotrope of water and said solvent and to form a mixture comprising substantially dehydrated basic lithium compounds in the remaining solvent;

(ii) adding to the mixture an alkoxyalkanol and an organic sulphonic acid so as to convert a part of the basic lithium compounds present to the lithium salt of the sulphonic acid;

(iii) thereafter introducing carbon dioxide into the mixture so as to react with the residual basic lithium compounds;

(iv) removing solvent by distillation; and (v) adding base oil to the process during one or more of steps (ii), (iii) and (iv) so that the desired product is obtained.

As a modification of this process, highly basic lithium sulphonates may be obtained by a process comprising:

(i) heating lithium hydroxide monohydrate, with a solvent and an alkoxyalkanol to remove water as an azeotrope comprising water, alkoxyalkanol and said solvent and to form a mixture comprising substantially dehydrated basic lithium compounds in the remaining solvent;

(ii) adding to this mixture an organic sulphonic acid so as to convert a part of the basic lithium compounds present to the lithium salt of the sulphonic acid;

(iii) thereafter introducing carbon dioxide into the mixture so as to react with the residual basic lithium compounds;

(iv) removing solvents by distillation; and (v) adding base oil to the process during one or more of steps (ii), (iii) and (iv) so that the desired product is obtained.

These processes enable one to obtain highly basic lithium sulphonates having relatively high total base numbers (TBN) of mgKOH/g or more. TBN is a measure of the basicity of a product and is measured by the method laid down by ASTM 2896.

One of the starting materials is lithium hydroxide monohydrate and this is generally commercially available and is often used in lithium grease manufacture. The solvent can be, for example, any aliphatic, naphthenic or aromatic solvent provided it forms an azeotrope with water; in particular, n-hexane, n-heptane, n-octane, n-dodecane, benzene, xylene, toluene, white spirit, naphtha or isoparaffins.

Usually, it is a hydrocarbon solvent but it could be a halogenated hydrocarbon, e.g. chlorobenzene. The most preferred solvents are toluene and xylene.

The amount of lithium hydroxide monohydrate dispersed in the solvent can vary, but usually the resulting solution contains 20 to 80, e.g. 40 to 60, weight percent of monohydrate based on the weight of solvent.

Although aromatic substituted alkoxyalkanols could be used, it is preferable to use an aliphatic alkoxyalkanol, especially one containing from 2 to 10 carbon atoms per molecule. Suitable examples of aliphatic alkoxyalkanols are methoxy methanol, methoxy ethanol, methoxy isopropanol, ethoxy methanol, 2-ethoxy ethanol, 2-butoxy-ethanol or propylene glycol ethers e.g. methoxy propanols, butoxy propanols or phenoxy propanols.

The amount of alkoxyalkanol added per mole of starting lithium hydroxide monohydrate in the process and in the modified processes of the invention can vary but usually the mole ratio of lithium hydroxide monohydrate to alkoxyalkanol is between 1:4 to 4:1, especially between 1.15:1 and 1:1.5.

The organic sulphonic acids are usually obtained from the sulphonation of nautral hydrocarbons or synthetic hydrocarbons; e.g. a mahogany or petroleum alkyl sulphonic acid; an alkyl sulphonic acid or an alkaryl sulphonic acid. Such sulphonic acids are obtained by treating lubricating oil base stocks with concentrated or fuming sulphuric acid to produce oil-soluble "mahogany" acids ot by sulphonating alkylated aromatic hydrocarbons. Sulphonates derived from synthetic hydrocarbons include those prepared by the alkylation of aromatic hydrocarbons with olefins or olefin ploymers; e.g. $C_{15}$–$C_{30}$ polypropenes or polybutenes. Also suitable are the sulphonic acids of alkyl benzenes, alkyl toluenes or alkyl xylenes, which may have one or more alkyl groups, wherein each group, may be straight or branched chain, preferably contains at least 12 carbon atoms. The preferred sulphonic acids have molecular weights of from 300 to 1000, for example, between 400 and 800, e.g. about 500. Mixtures of any of these sulphonic acids may also be used.

The mole ratio of sulphonic acid to lithium hydroxide monohydrate is usually between 1:5 and 1:36, for example between 1:15 to 1:20 and in the case where 400 TBN product is desired a ratio of about 1 mole of sulphonic acid per 17 moles of lithium hydroxide monohydrate is especially preferred.

The sulphonic acid, e.g. an alkyl benzene sulhonic acid, acts as a surfactant, and this may be sufficient especially when it has a relatively high molecular weight aliphatic chain e.g. of molecular weight more than about 400. However, it is often desirable to include another surfactant having a long aliphatic chain, usually with molecular weight of 700 or greater, for example about 900, in the reaction mixture in both the processes and the modified process of this invention.

This additional surfactant is preferably a mono- or di-(hydrocarbyl) substituted acid or anhydride, or an ester, amide, imide, amine salt or ammonium salt of a dicarboxylic acid, wherein the (or each) hydrocarbyl group which may be substituted contains at least 30 carbon atoms.

The most preferred dicarboxylic compounds are those where the optionally substituted hydrocarbyl group contains 40 to 200 carbon atoms and has no atoms other than carbon, hydrogen and halogen, and especially unsubstituted hydrocarbyl groups. Preferred hydrocarbyl groups are aliphatic groups.

The acid, anhydride, ester, amide, imide, amine salt or ammonium salt is preferably substantially saturated, but the hydrocarbyl group(s) may be unsaturated. In practice, it is preferred that the hydrocarbyl group(s) be a polymer of a monolefin, for example, a $C_2$ to $C_5$ monolefin, such as polytheylene, polypropylene or polyisobutene. Such polymers will usually have only one double bond so that they could be regarded as predominantly saturated, especially since they must have at least 30 carbon atoms.

Mono-(hydrocarbyl)-substituted dicarboxylic acids and their derivatives where the carboxylic groups are separated by 2 to 4 carbon atoms are preferred. In general, acids or anhydrides are the preferred surfactant. Howevwer, if an ester, monoamide or ammonium salt is used, it is preferred that the N-substituents or O-substituents are alkyl groups, especially $C_1$ to $C_5$ alkyl groups, for example, methyl, ethyl or propyl. If desired, however, the ester could be derived from a glycol, for example, ethylene glycol or propylene glycol.

The most preferred additional surfactants are monosubstituted succinic acids and anhydrides especially polyisobutenyl succinic acids or anhydrides, preferably where the polyisobutenyl group has 30 to 200 carbon atoms, especially 45 to 55 carbon atoms. Such anhydrides are frequently known as PIBSA.

When such an acid, anhydride or ester is used, the molar ratio of organic sulphonic acid to the acid, amide, imide, amine salt, ammonium salt, anhydride or ester can vary but is usually between 10:1 and 2:1, e.g. between 8:1 and 4:1.

The first step of the process and of the modified process is the heating of the mixture comprising lithium hydroxide monohydrate and hydrocarbon solvent to remove the water of hydration as an azeotrope of water (alkoxyalkanol if initially present) and said solvent. This heating which in effect is azeotropic distillation should be continued until substantially all the water of hydration is removed from the reaction mixture If this is not done, then surprisingly, it has been found that turbidity occurs during subsequent carbonation and the resultant products are unfilterable. Usually this distillation takes at least one hour, and in smaller scale preparations times of 1.5 to 2 hours are typical for substantial removal of water, although on a larger scale longer distillation times may be needed. Progress of the water removal may be monitored by measuring the water content of the azeotrope.

If no alkoxyalkanol is present at this stage, the azeotrope will be of water and solvent, but if an alkoxyalkanol is present then the azeotrope will usually be one of water, solvent and alkoxyalkanol.

It is an important preferred feature of the invention that the water removal is controlled so that the lithium hydroxide monohydrate is dehydrated, but that it is not continued to such an extent as to promote the formation of any substantial amount of the alkoxyalkoxide which in the presence of alkoxyalkanol is believed to be capable of formation by the reaction:

$$LiOH + R'OROH \rightarrow R'OROLi + H_2O$$

where R′ is an alkyl radical and R is an alkylene radical. If alkoxide is formed then hydrolysis is required, and if significant amounts of alkoxide are present water will need to be added following carbonation to form the desired lithium overbased product. By avoiding this hydrolysis step the overall carbon dioxide requirement is reduced, since when alkoxide is present more carbon dioxide is consumed which in the hydrolysis is released. A possible mechanism for this release is as follows:

Alkoxide carbonation:

$$R'OROLi + CO_2 \rightarrow R'OROCOOLi$$

Hydrolysis:

$$2R'OROCOOLi + H_2O \rightarrow 2R'OROH + Li_2CO_3 + CO_2$$

After the removal of water by azeotroping as described above and the addition of the organic sulphonic acid and optionally the dicarboxylic acid, anhydride or ester, amide, imide, amine salt or ammonium salt and where not already present, an alkoxyalkanol, the reaction mixture may be heat-soaked, e.g. at a temperature of about 80° C. to 100° C. The sulphonic acid and dicarboxylic acid, anhydride, ester, amide, imine, amine salt or ammonium salt are usually introduced as solutions in diluent oil, e.g. an aliphatic or aromatic hydrocarbon. The purpose of this heat soaking is to effect neutralisation of the organic sulphonic acid, and if used, the dicarboxylic adic, anhydride, monoamine salt or monoammonium salt by the substantially dehydrated basic lithium compounds. The time taken for this heat soaking is usually from 10 to 30 minutes, e.g. about 20 minutes.

After this heat soaking step, carbon dioxide is introduced into the reaction mixture which is preferably maintained at a temperature of from ambient to the reflux temperature of the mixture, typically 120° C., more preferably between 80° C. and 100° C., for example, about 90° C. The amount of carbon dioxide which is blown into or injected into the reaction mixture should be 90% to 115%, e.g. about 105% of the theoretical amount required to react with the lithium hydroxide.

The residual basic lithium compounds will mostly be in the form of lithium hydroxide which may react with $CO_2$ according to the reaction:

$$2LiOH + CO_2 \rightarrow Li_2CO_3 + H_2O$$

to form the desired overbased product.

In practice, carbon dioxide is blown in until no more carbon dioxide is absorbed. Rates are usually chosen to introduce this carbon dioxide over 2 to 4 hours, e.g. about 3 hours.

The next step in the process is to remove the solvents by distillation. Usually, this takes place by atmospheric distillation to about 160° C. followed by distillation under reduced pressure so as to remove substantially all water, alkoxyalkanol and solvent. Following this distillation step, solid contaminants may be removed from the product preferably by filtering or centrifuging. The desired product is then the filtrate or centrifugate.

The desired product of the invention is a solution in oil, and therefore oil is added to the process in step (ii), (iii) or (iv). Most preferably the oil is added with the sulphonic acid in step (ii). Base oils used in the process are preferably lubricating oils as described hereinafter.

The process of the invention enables a high quality, high TBN lithium sulphonate product to be obtained in good yields (e.g. 95%+ of theoretical) with reduced amounts of material losses in sludge and/or sediment and reduced problems in waste disposal which can arise when large amounts of sludge or flocculent material are produced. The process of the invention in particular provides a means of preparing a preferred product with a TBN of at least 250 mg(KOH)/g., preferably 250 to 600 mg (KOH)/g, more preferably 350 to 500 mg (KOH)/g, and specifically in the region of 400 mg(KOH)/g.

The overbased additive of this invention is suitable for use in fuels or lubricating oils, both mineral and synthetic. The lubricating oil may be an animal, vegetable or mineral oil, for example, petroleum oil fractions ranging from napthas or spindle oil to SAE 30, 40 or 50 lubricating oil grades, castol oil, fish oils or oxidized mineral oil.

Suitable synthetic ester lubricating oils include diesters such as dioctyl adipate, dioctyl sebacate, didecyl azelate, tridecyl adipate, didecyl succinate, didecyl glutatate and mixtures thereof. Alternatively the synthetic ester can be a polyester such as that prepared by reacting polyhydric alcohols such as trimethylolpropane and pentaerythritol with monocarboxylic acids such as butyric acid, caproic acid, caprylic acid and pelargonic acid to give the corresponding tri- and tetraesters.

Also, complex esters may be used as base oils such as those formed by esterification reactions between a dicarboxylic acid, a glycol and an alcohol and/or a monocarboxylic acid.

Blends of diester with minor proportions of one or more thickening agents may also be used as lubricants. Thus one may use blends containing up to 50% by volume of one or more water-insoluble polyoxyalkylene glycols, for example, polyethylene or polypropylene glycol, or mixed oxyethylene/oxypropylene glycol.

The amount of overbased detergent added to the lubricating oil should be a minor proportion, e.g. between 0.01% and 10% by weight, preferably between 0.1% and 5% by weight.

When used in fuels as a detergent or combustion improver the overbased material is used in minor proportion, e.g. between 0.01% and 10% by weight of the fuel.

The final lubricating oil may contain other additives according to the particular use for the oil. For example, viscosity index improvers such as ethylene-propylene copolymers may be present as may ashless dispersants such as substituted succinic acid derivatives, other metal containing dispersant additives, the well known zinc dialkyl-dithiophosphate antiwear additives, antioxidants, demulsifiers, corrosion inhibitors, extreme pressure additives and friction modifiers. A preferred anti-oxidant which may be used in such lubricating oils is copper present as a oil-soluble copper compound in an amount of from 5 ppm to 500 ppm (by weight of the oil), as described in EP No. 24146. The invention also includes an additive concentrate comprising an oil solution of an overbased lithium sulphonate of the invention comprising 10 to 90 wt %, preferably 40 to 60 wt % of overbased lithium sulphonate (active matter) based on the weight of oil.

The invention is now described with reference to the following examples:

EXAMPLE 1

A reaction mixture of lithium hydroxide monohydrate 588 g (14 mole), toluene 1200 g and 2-ethoxyethanol 1450 g (16.1 mole) was subjected to azeotropic distillation using a Dean & Stark receiver until 350 $cm^3$ of azeotrope was recovered. The composition of this azeotrope was water 72.3 mass %, 2-ethoxyethanol 26.9 mass % and toluene 0.8 mass %. The density of this mixture was 0.985 $g/cm^3$. The total water recovered was therefore $350\times0.985\times0.723=249.3$ g. The theoretical water $=14\times18=252$ grams. Therefore the water recovered was 98.8% of the theoretical water of hydration.

To the dehydrated mixture, a 70% oil solution of mixed alkyl benzene sulphonic acids (the major component bein $C_{24}$ branched alkyl benzene sulphonic acids) 536 g, a 70% oil solution of polyisobutenyl succinic anhydride (PIBSA 1000 mol wt.) 80 g and Stanco 150 (a mineral diluent oil) 473 g were added. The temperature was adjusted to 90° C. and carbon dioxide injected into the mixture for 3.52 hours 785 $cm^3$/min. This is equivalent to 300.7 grams of $CO_2$. The theoretical quantity of $CO_2$ consumed would be 289 grams. This makes an allowance for the lithium hydroxide consumed in neutralising the sulphonic acid and PIBSA. The amount of $CO_2$ used was 104% of theoretical. On completion of the carbonation process, the apparatus was changed from reflux to distillation and the solvents were removed by atmospheric distillation to 160° C. followed by distillation at reduced pressure The product was then filtered using DC4200 filter aid. The filtration through a pressure filter was very rapid requiring only 10 psi (70 kPa) to complete the operation. The product prior to filtration accounted for 99.6% of the theoretical yield. The filtered material was bright and clear and contained 20.7% lithium sulphonate and had a TBN of 468 mg KOH/g.copolymers

EXAMPLE 2

A mixture of lithium hydroxide 235.2 g (5.6 mole) and toluene 480 g was subjected to azeotropic distillation with a Dean & Stark receiver until no further water was given off. 100 $cm^3$ of water was recovered. The theoretical yield was 100.8 gms. A surfactant mixture of the same sulphonic acid as used in Example 1, (214.4 g), PIBSA (32 g) and Stanco 150 (189.2 g) was then added, followed by the 2-ethoxy-ethanol 580 g. The temperature was then adjusted to 90° C. and the mixture injected with carbon dioxide at 314 $cm^3$/min for 3.25 hours when total breakthrough occurred. The product was then distilled and worked up as in Example 1 to give a bright clear 474 mg KOH/g TBN material.

EXAMPLE 3

This preparation was a repeat of Example 1 except that 2-butoxyethanol was used in place of 2-ethoxyethanol. After rapid filtration, a bright clear 469 mg KOH/g TBN material was formed.

EXAMPLE 4

(Comparative)

A mixture of lithium hydroxide monohydrate 235.2 g and toluene 480 g was subjected to azeotropic distillation to remove the water of hydration. 100 $cm^3$ of water was recovered. The surfactant mixture of the sulphonic acid of Example 1 214.4 g, PIBSA 32 g and Stanco 150

189.2 g was then added and the temperature adjusted to 90° C. On carbonation at 314 $cm^3$/min, very little carbon dioxide was absorbed as seen by the exit flow meter and the preparation was abandoned. This example shows that if no alkoxyalkanol is used, little or no overbased lithium sulphonate will be produced.

EXAMPLE 5

(Comparative)

This preparation was a repeat of Example 2 except isodecanol was used in place of 2-ethoxyethanol. On carbonation $CO_2$ breakthrough occurred immediately and even after prolonged carbonation (6 hours) large amounts of solid material were still present and the preparation was abandoned. This shows that substantially no overbased additive is obtained if an alcohol which is not an alkoxyalkanol is used.

EXAMPLE 6

(Comparative)

This preparation was also a repeat of Example 2 except methanol was used to replace the 2-ethoxyethanol and the temperature of carbonation was reduced to 60° C.

The initial carbonation proceeded normally but as carbonation continued, a haze formed until at total breakthrough a muddy solution resulted. Some improvement occurred during the removal of the methanol but at 160° C. the solution was again very muddy in appearance and the preparation was abandoned. Again this shows that an alkoxyalkanol should be used to achieve the advantage results of our invention.

EXAMPLES 7 to 11

In these examples, lithium hydroxide monohydrate 235.2 g, 2-ethoxyethanol 580 g and toluene 480 g were subjected to azeotropic distillation with a Dean & Stark receiver until the amounts of azeotrope, shown in the following table, were removed. The resultant solutions were then carbonated at 90° C. in the presence of the sulphonic acid of Example 1 214.4 g, PIBSA 32 g and Stanco 150 189.2 g at 314 $cm^3$/min.

| Example | 7 | 8 | 9 | 10 (COMPARATIVE) | 11 (COMPARATIVE) |
|---|---|---|---|---|---|
| $cm^3$ of azeotrope recovered | 325 | 204 | 130 | 100 | 0 |
| water of hydration removed | 100% | 100% | 100% | 80% | 0% |
| alkoxide formed from analysis of azeotrope | 100% | 33% | 0% | 0% | 0% |
| time for azeotrope | 21 hrs | 5.8 hrs | 1.6 hrs | 0.8 hrs | 0 |
| hydrolysis* step | Yes | Yes | No | No | No |
| TBN mgKOH/g | 459 | 478 | 466 | Colloid precipitation | Colloid precipitation |

In Examples 7 and 8 it was necessary to carry out a hydrolysis step. On removal of the solvents after carbonation, the products were extremely viscous and it was necessary to redissolve them in toluene and slowly add a 1:3 mixture of water and 2-ethoxyethanol until evolution of $CO_2$ ceased. A possible reaction sequence is as follows:

$$LiOH\ H_2O \longrightarrow LiOH + H_2O \text{ dehydration step}$$

$$LiOH + C_2H_5OC_2H_4OH \longrightarrow C_2H_5OC_2H_4OLi + H_2O$$

(formation of alkoxyalkoxide if more than water of hydration removed)

$$C_2H_5OC_2H_4OLi + CO_2 \longrightarrow C_2H_5OC_2H_4O{-}CO{-}OLi$$

(carbonation of alkoxide)

$$2C_2H_5OC_2H_4O{-}CO{-}OLi + H_2O \longrightarrow 2C_2H_5OC_2H_4OH + Li_2CO_3 + CO_2$$

(hydrolysis step)

The diluent toluene and 2-ethoxyethanol from the hydrolysing mixture and that released from the carbonated alkoxide were then removed by vacuum distillation to give high TBN mobile solutions similar to that obtained in Example 9. In Examples 10 and 11 where insufficient water of hydration had been removed turbidity formed during carbonation and the resultant products were unfilterable. Thus, the necessity of removing the water of hydration can be seen. Example 9 had the advantages as compared with Examples 7 and 8 of using less carbon dioxide to form the desired product, of having a lower cycle time, and avoiding the need for a hydrolysis step.

EXAMPLE 12

The preparation in Example 1 was repeated except less 2-ethoxyethanol 743 g anmd less toluene 600 g was used. Although not processing quite as well as Example 1, the product was slightly hazy after carbonation, a fast filtering 432 mgKOH/g TBN, bright and clear additive was formed.

I claim:

1. A process for preparing an oil solution of a highly basic lithium sulphonate having a TBN of at least 250 mg(KOH)/gm, which comprises:

(i) heating lithium monohydrate with a solvent to remove water as an azeotrope of water and said solvent, without formation of any substantial amount of lithium alkoxide, and to form a mixture comprising substantially dehydrated basic lithium compounds in the remaining solvent;

(ii) adding to the mixture an alkoxyalkanol and an organic sulphonic acid so as to convert a part of the basic lithium compounds to the lithium salt of the sulphonic acid;

(iii) thereafter introducing carbon dioxide into the mixture so as to react with the residual basic lithium compounds;

(iv) removing solvent by distillation; and (v) adding base oil to the process during one or more of steps (ii), (iii) and (iv) so that the desired product is obtained.

2. A process as claimed in claim 1, in which in step (ii) there is added along with the organic sulphonic acid a surfactant.

3. A process as claimed in claim 2 in which the surfactant is a polyisobutenyl succinic acid or anhydride wherein the polyisobutenyl group has 30 to 200 carbon atoms.

4. A process as claimed in claim 1, in which the mole ratio of lithium hydroxide monohydrate to alkoxyalkanol is from 1:4 to 4:1.

5. A process as claimed in claim 1, in which following addition of the organic sulphonic acid in step (ii) the reaction mixture is heated to from 80° to 100° for from 10 to 30 minutes.

6. A process for preparing a highly basic lithium sulphonate having a TBN of at least 250 mg(KOH)/gm, which comprises:

(i) heating lithium monohydrate with a solvent and an alkoxyalkanol to remove water as an azeotrope comprising water, alkoxyalkanol and said solvent, without formation of any substantial amount of lithium alkoxide, and to form a mixture comprising substantially dehydrated basic lithium compounds in the remaining solvent;

(ii) adding to the mixture an organic sulphonic acid so as to convert a part of the basic lithium compounds present to the lithium salt of the sulphonic acid;

(iii) thereafter introducing carbon dioxide into the mixture so as to react with the residual basic lithium compounds;

(iv) removing solvent by distillation; and (v) adding base oil to the process during one or more of steps (ii), (iii) and (iv) so that the desired product is obtained.

7. A lubricating oil composition comprising a lubricating oil and 0.01% to 10% by weight of the lithium sulphonate prepared by claim 1.

8. A lubricating oil composition as claimed in claim 7 which further comprises from 5 to 500 ppm (by weight based on the composition) of added copper in the form of an oil-soluble copper compound.

9. An additive concentrate comprising a lubricating oil and 10 to 90% by weight of the lithium sulphonate prepared by claim 1.

* * * * *